US009357819B2

(12) United States Patent
Blanchard

(10) Patent No.: US 9,357,819 B2
(45) Date of Patent: Jun. 7, 2016

(54) SLOTTED BODY JEWELRY SURFACE ANCHOR

(71) Applicant: Anatometal, Inc., Santa Cruz, CA (US)

(72) Inventor: Barry D. Blanchard, Santa Cruz, CA (US)

(73) Assignee: Anatometal, Inc., Santa Cruz, CA (US)

( * ) Notice: Subject to any disclaimer, the term of this patent is extended or adjusted under 35 U.S.C. 154(b) by 0 days.

(21) Appl. No.: 13/745,356

(22) Filed: Jan. 18, 2013

(65) Prior Publication Data

US 2013/0186135 A1 Jul. 25, 2013

Related U.S. Application Data

(60) Provisional application No. 61/588,581, filed on Jan. 19, 2012.

(51) Int. Cl.
*A44C 15/00* (2006.01)
*A44C 7/00* (2006.01)

(52) U.S. Cl.
CPC ..... *A44C 15/0045* (2013.01); *A44C 7/00* (2013.01); *A44C 15/0035* (2013.01); *Y10T 24/13* (2015.01)

(58) Field of Classification Search
CPC ..... A44C 15/00; A44C 15/0035; A44C 15/0045; A44C 7/00; A44C 25/00; A44C 15/006; A61C 8/0019; Y10T 24/13
USPC ..... 63/14.1–14.9, 12; 24/113 R, 113 MP, 24/289, 290, 67 P, 293, 295; 411/166, 174; 433/176, 172, 173
See application file for complete search history.

(56) References Cited

U.S. PATENT DOCUMENTS

| | | | | |
|---|---|---|---|---|
| 3,316,601 | A * | 5/1967 | Ryan | 24/113 R |
| 3,465,441 | A * | 9/1969 | Linkow | 433/176 |
| 3,837,080 | A * | 9/1974 | Pasqualini | 433/176 |
| 4,217,100 | A * | 8/1980 | Edelman | 433/176 |
| 5,577,301 | A * | 11/1996 | De Maagd | 24/295 |
| 8,117,866 | B2 * | 2/2012 | Crockett | 63/12 |
| 2011/0265513 | A1 * | 11/2011 | Baer | 63/12 |

OTHER PUBLICATIONS

Body Candy Body Jewelry, "Dermal Anchors", Nov. 18, 2010, bodycandy.com, pp. 1-3.*
Body Candy Body Jewelry, "Grade 23 Solid Titanium Internally Threaded Green Gem 3MM Dermal Ball Top", Nov. 18, 2010, bodycandy.com, pp. 1-3.*
Body Candy Body Jewelry, "Grade 23 Solid Titanium Single Piece 2-Hole Dermal Anchor", Nov. 8, 2010, bodycandy.com, pp. 1-3.*

* cited by examiner

*Primary Examiner* — Abigail Morrell
(74) *Attorney, Agent, or Firm* — Alleman Hall McCoy Russell & Tuttle LLP

(57) ABSTRACT

A surface anchor for body jewelry is provided, which typically includes a base formed of an elongated plate. The base may have a proximate end to which a post is coupled. The post may include a fastening structure for securing the body jewelry to the post. The base may further include a distal end, and the distal end may include a slot extending from an opening at an edge of the base inward into an internal region of the base. The slot may be bounded on opposite sides by a pair of elongated structures, and may be longer than it is wide. Body jewelry may be attached to the post to form a slotted body jewelry assembly.

20 Claims, 3 Drawing Sheets

SLOTTED BODY JEWELRY SURFACE ANCHOR

CROSS REFERENCE TO RELATED APPLICATIONS

This application is a non-provisional of and claims priority to U.S. Provisional Patent Application Ser. No. 61/588,581, filed Jan. 19, 2012 and entitled SLOTTED BODY JEWELRY SURFACE ANCHOR, the entire contents of which are incorporated herein by reference in their entirety for all purposes.

BACKGROUND

People have enjoyed the aesthetic pleasures of adorning their bodies for millennia. One ancient form of body adornment is body piercing, in which a hole is made in a portion of the human body, and an ornamental object is anchored therein. A recent advancement in the body piercing arts is the development of the technique of inserting a surface anchor under the skin, to form a semi-permanent anchor on which body jewelry may be attached. The surface anchor offers the aesthetic advantage of causing the body jewelry to appear to be directly screwed to the wearer's body, which is visually striking. Some prior surface anchors included a base plate that is formed of a flat solid piece of metal, but these were relatively heavy and prone to slide undesirably under the skin. Other prior surface anchors included a base plate with internal holes formed therein. The holes in the base plate allowed tissue to grow therethrough in situ, thereby securing the anchor against sliding. However, these surface anchors with internal holes present a drawback to those people who eventually decide to remove the anchor, since tissue growth through the holes can result in a painful and injurious removal.

SUMMARY

A surface anchor for body jewelry is provided, which typically includes a base formed of an elongated plate. The base may have a proximate end to which a post is coupled. The post may include a fastening structure for securing the body jewelry to the post. The base may further include a distal end, and the distal end may include a slot extending from an opening at an edge of the base inward into an internal region of the base. The slot may be bounded on opposite sides by a pair of elongated structures, and may be longer than it is wide. Body jewelry may be attached to the post, to form a slotted body jewelry assembly.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

As illustrated in FIGS. 1-9, a surface anchor 10 for body jewelry is provided. The surface anchor typically includes a base formed of an elongated plate. The plate provides stability when inserted under the skin of a subject. The plate includes a proximate end 12*c* and a distal end. The proximate end 12*c* is gradually radiused. In the illustrated embodiment, a 0.054 inch radius R is used. Alternatively, a radius R of between 0.04 and 0.07 inches may be used, preferably between 0.05 and 0.06 inches. A radius R in this range provides a smooth curved surface that may easily be inserted into and removed from a slot in the skin of a user, as described below.

Figure 1:
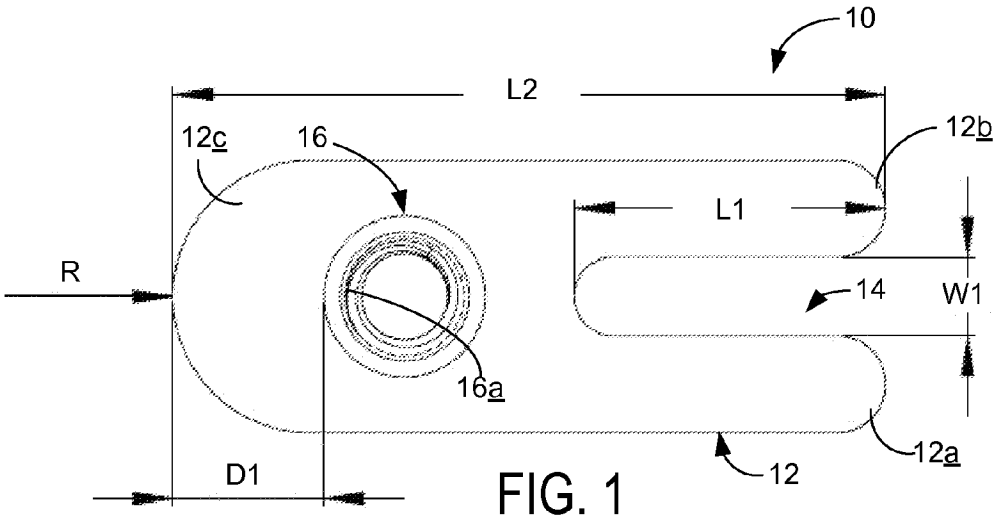
FIG. 1 is a top view of a slotted surface anchor for body jewelry, according to an embodiment of the present invention.
Figure 2:
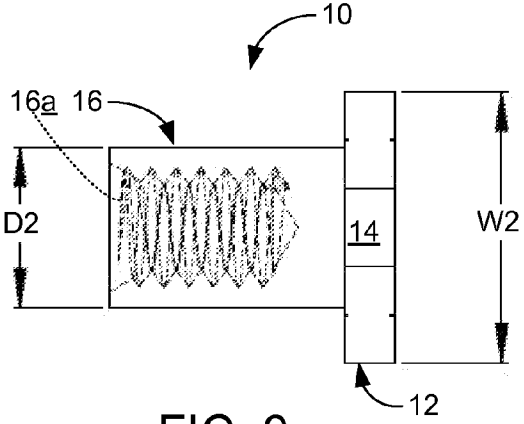
FIG. 2 is a right side view of the surface anchor of FIG. 1.
Figure 3:
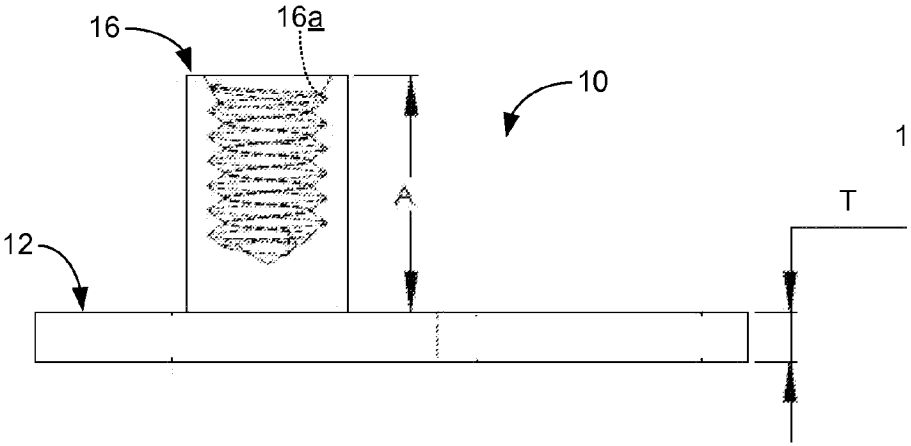
FIG. 3 is a front view of the surface anchor of FIG. 1.
Figure 4:
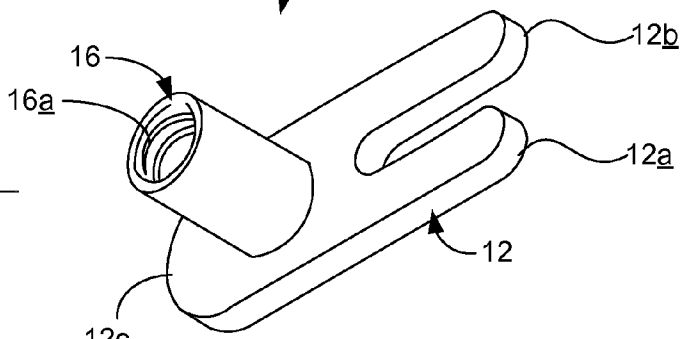
FIG. 4 is a top perspective view of the surface anchor of FIG. 1.
Figure 6:
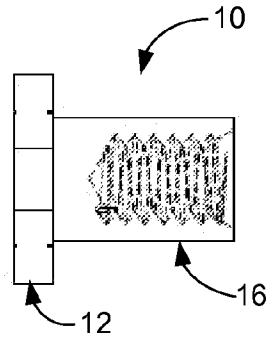
FIG. 6 is another left side view of the surface anchor of FIG. 1.
Figure 8:
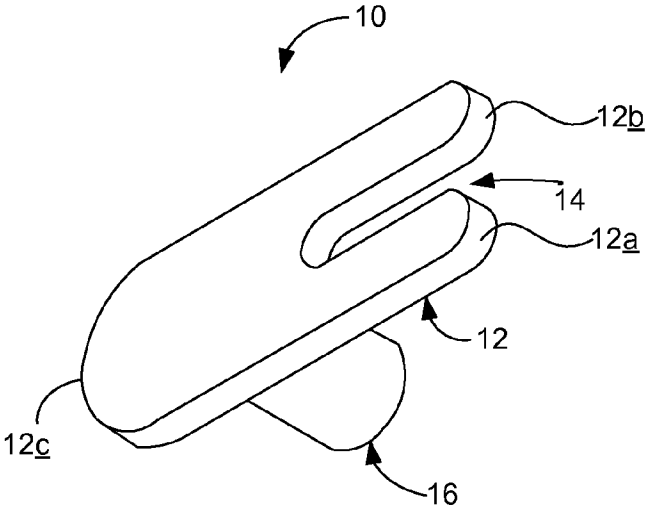
FIG. 8 is a bottom perspective view of the surface anchor of FIG. 1.
Figure 5:
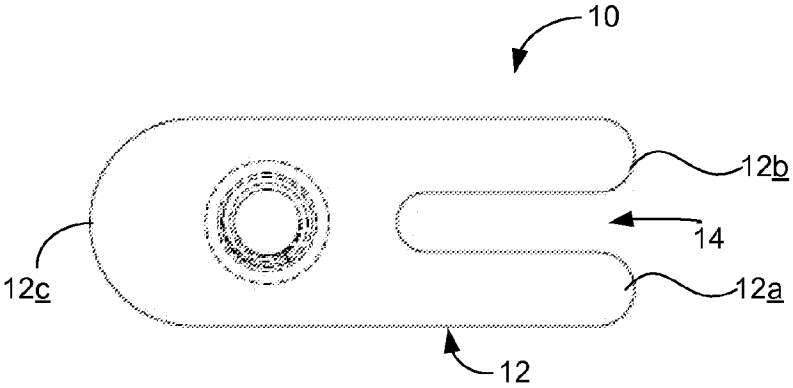
FIG. 5 is a bottom view of the surface anchor of FIG. 1.
Figure 7:
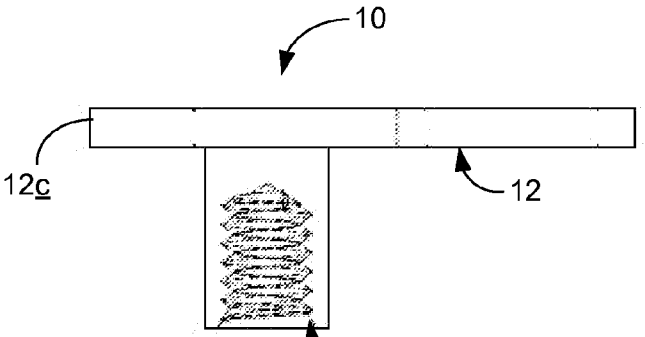
FIG. 7 is a rear view of the surface anchor of FIG. 1.
Figure 9:
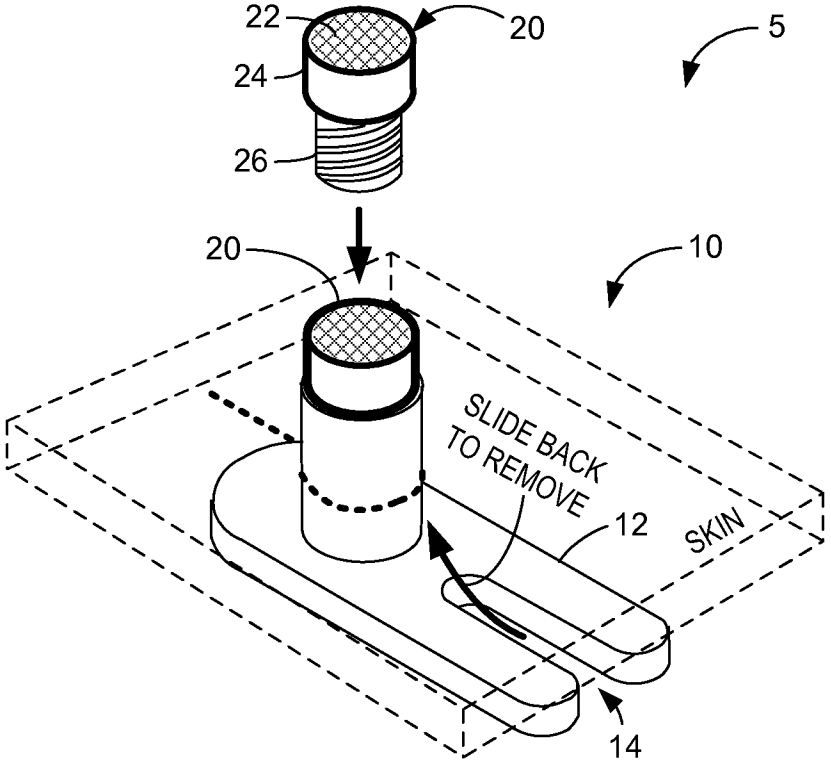
FIG. 9 is a perspective view of the surface anchor of FIG. 1, shown in situ prior to removal.

A proximate end 12*c* of the base is coupled to a post 16, to which body jewelry may be attached. The post 16 is set back a distance D1 0.06 inches from the furthest tip of the radiused proximate end 12*c*, although a setback distance D1 in the range of 0.03-0.08 could also be used. Setback distances in these ranges provide sufficient horizontal surface around the post 16 for the tissue to securely contact, which may inhibit the back end of the surface anchor 10 from becoming dislodged after being placed in situ. The height of the post, indicated at A in the Figures, may be of varying height depending on the preference of the user. For example, a height A of 1/16 inch, 2 mm, 3/32 inch, 1/8 inch, 5/32 inch, or 3/16 inch may be used. The post is designed to stick out through the skin when the plate is installed in situ under the skin, as best seen in FIG. 9. Returning to FIGS. 1-8, the post 16 includes a fastening structure 16*a* for securing the body jewelry to the post. The fastening structure 16*a* is illustrated as internal threads that engage with corresponding threads formed in the body jewelry, although it will be appreciated that other fastening structures may also be employed. The outer diameter D2 of the post is typically 0.064 inches, with posts being available having an outer diameter from 0.16 to 0.048 inches. It will be appreciated that this range of post sizes corresponds to 8 ga to 18 ga, in gauge units.

A distal end of the base includes a slot 14 extending from an edge of the base inward into an internal region of the base. The slot is bounded on opposite sides by a pair of elongated structures 12*a* and 12*b*, which serve to enable the anchor to slide into place within the skin, also provide a broad footprint for support. The slot is open to the distal end of the base, and is shaped to be longer than it is wide. The slot typically has a width W1 of 0.03 inches, and a length L1 of 0.12 inches, with a width W1 between 0.01 and 0.05 inches, and a length L1 between 0.05 and 0.2 inches being possible. It will be appreciated that the width to length ratio for the slot is typically less than 1:1, and is approximately 0.25 in the illustrated embodiment. Width to length ratios of between 1:5 and 1:1 are possible, with 1:4 being preferred in some cases. The slot width W1 is between 1/4 and 1/2 of the width W2 of the elongated plate, and in the preferred embodiment is 0.28 times the width of the elongated plate. Slot and elongated structure dimensions in these ranges described above enable the elongate structures to be sufficiently strong to provide horizontal stability when in situ, while also enabling sufficient tissue to grow into the slot to prevent rotational or other movement of the surface anchor in situ.

An inside perimeter of the slot 14 is typically formed by two parallel sides connected together by a radiused edge on a central, innermost edge of the slot. Alternatively, the sides of the slot may open at an angle so as to get wider toward the opening or mouth of the slot. The sides of the slot may also be curved instead of straight in some embodiments. The mouth or opening of the slot 14 typically opens to the distal end of the elongated plate 12, in between the distal ends of each of elongated structures 12*a*, 12*b*. Each of the distal ends of elongated structures 12*a*, 12*b* is typically radiused. These radiuses, like all other radiuses described herein, may alternatively be squared ends, or polygonal in shape, depending on the preferences of the user. The slot 14 is typically centered widthwise within the elongated plate, although in alternative embodiments it need not be so centered.

The elongated plate typically has a length L2 of 0.28 inches, although the length L2 may range between 0.2 and 0.3 inches, or in some embodiments, 0.15 and 0.35 inches. Other lengths L2 may also be provided. The elongated plate is typically about 0.11 inches in width W2, with a width W2 of between 0.05-0.2 inches being possible, and preferably has a width W2 of between 0.08 and 0.12 inches. The length to width ratio for the elongated plate 12 is typically between than 2:1 and 3:1, and in a preferred embodiment is about 2.6:1. The thickness T of the elongated plate is 0.02 inches, although any suitable thickness T may be used, such as between 0.01 and 0.03 inches. Elongated plate dimensions in these ranges enable the elongate plate to serve as a strong, secure base for the post and jewelry in situ, and help ensure the post extends orthogonal to the skin surface of the user, without undesirably tilting or leaning at an angle.

As shown in FIG. 9, during use the surface anchor 10 may be inserted in situ under the skin of a user, with the post extending through an opening in the skin. Body jewelry 20 may be secured to the post of the surface anchor, to thereby form a slotted body jewelry assembly 5. The body jewelry 20 typically includes a jeweled or other ornamental surface 22, mounted in a setting 24. The body jewelry 20 also typically includes a threaded shaft 26 that engages with the internally threaded post 16 of the surface anchor. In situ, the surface anchor sits with the elongated plate 12 resting under the skin, and the post 16 extending through a semi-permanent opening in the skin. As the user wears the surface anchor for a period of time, tissue may grow into the slot 14, securing the surface anchor against rotation under the skin. This may be an advantage for users who wish to secure to the anchor body jewelry 20 that has a particular orientation, for example, since the anchor is less likely to rotate undesirably when the tissue has grown within the slot.

Should a user desire to have the surface device removed, an incision may be made in the skin as indicated in FIG. 9, and the surface anchor may be pulled out of the incision in a direction generally parallel to slot 14 and in the opposite direction as the opening of slot 14, as indicated by the large arrow in FIG. 9. In this way tissue that has grown within the slot 14 may easily slide out the opening in the end of slot 14, to enable the surface anchor to be easily removed. This has the benefit of avoiding the damage discussed in the Background associated with the removal of surface anchors with internally formed holes. The tissue in such holes of prior devices would be prone to rip or tear when the surface anchor was removed. With anchors according to the subject invention, the injury and pain associated with such tearing is avoided. Typically, the surface anchor is manufactured of a metal such as implant grade titanium, so avoid adverse reaction with the tissue.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A surface anchor for body jewelry, comprising:

a base formed of an elongated plate having a planar top face and a planar bottom face, the elongated plate being longer than it is wide, the base having a proximate end to which a post is coupled, such that the post is coupled to and extends orthogonally from the planar top face of the base, the post having a diameter smaller than a width of the base and being positioned within an interior region of the planar top face so that the planar top face flanges outward for a distance around an entire circumference of the post, the post including a fastening structure for securing the body jewelry to the post, the base further including a distal end, the distal end including a slot interrupting a distal edge and extending from an opening at the distal edge of the base through a total thickness of the elongated base plate and inward into an internal region of the base, the slot bounded on opposite sides by a pair of elongated structures, the slot having an inner surface with two sides which extend in parallel along their entire lengths, the slot being longer than it is wide and collectively with the pair of elongated structures of the base forming a U-shape, the U-shape open at the distal edge of the base and being formed in a plane of the base that is orthogonal to the post; and wherein the base is unperforated, including no internally formed holes connecting the planar top face to the planar bottom face.

2. The surface anchor of claim 1, wherein the inner surface of the slot is formed by the two parallel sides connected together by a curved edge on a central innermost edge of the slot.

3. The surface anchor of claim 2, wherein the opening of the slot opens to the distal end of the elongated plate, in between respective distal ends of each of the elongated structures.

4. The surface anchor of claim 3, wherein each of the distal ends of the elongated structures is curved.

5. The surface anchor of claim 1, wherein the slot is centered widthwise within the elongated plate.

6. The surface anchor of claim 1, wherein the diameter of the post is larger than a width of the slot.

7. The surface anchor of claim 1, wherein the slot has a width to length ratio of between 1:5 and 1:1.

8. The surface anchor of claim 1, wherein the slot has a width between 0.01 and 0.05 inches, and has a length between 0.05 and 0.2 inches.

9. The surface anchor of claim 1, wherein the slot width is between ¼ and ½ of the width of the elongated plate.

10. The surface anchor of claim 1, wherein the elongated plate has a length of between 0.15 and 0.35 inches.

11. The surface anchor of claim 1, wherein the width of the elongated plate is of between 0.05 and 0.2 inches.

12. The surface anchor of claim 1, wherein a length to width ratio for the elongated plate is between 2:1 and 3:1.

13. The surface anchor of claim 1, wherein the total thickness of the elongated plate is between 0.01 and 0.03 inches.

14. A slotted body jewelry assembly, comprising:

a surface anchor for body jewelry, including:

a base formed of an elongated plate having a planar top face and a planar bottom face, the elongated plate being longer than it is wide, the base having a proximate end to which a post is coupled, the post including a fastening structure for securing the body jewelry to the post, such that the post is coupled to and extends orthogonally from the planar top face of the base, the post having a diameter smaller than a width of the base and being positioned within an interior region of the planar top face so that the planar top face flanges outward for a distance around an entire circumference of the post, the base further including a distal end, the distal end including a slot interrupting a distal edge and extending from an opening at the distal edge of the base through a total thickness of the elongated base plate and inward into an internal region of the base, the slot bounded on opposite sides by a pair of elongated structures, the slot having an inner surface with two sides which extend in parallel along their entire lengths, the slot being longer than it is wide and collectively with the pair of elongated structures of the base forming a U-shape, the U-shape open at the distal edge of the base and being formed in a plane of the base that is orthogonal to the post;

wherein the base is unperforated, including no internally formed holes connecting the planar top face to the planar bottom face; and body jewelry removably secured to the post of the surface anchor.

15. The slotted body jewelry assembly of claim 14, wherein the fastening structure is an internally threaded post of the surface anchor; and wherein the body jewelry includes:

a jeweled or ornamental surface mounted in a setting; and a threaded shaft configured to engage with the internally threaded post of the surface anchor.

16. The slotted body jewelry assembly of claim 14, wherein the surface anchor is configured to sit with the elongated plate resting under the skin of a user, and the post is configured to extend through a semi-permanent opening in the skin, and the body jewelry is configured to be removably secured to the post external to the opening in the skin when worn by the user.

17. The slotted body jewelry assembly of claim 14, wherein the slot is configured with a width sufficient to allow human tissue of the user to grow into the slot in situ, thereby securing the surface anchor against rotation under the skin.

18. The slotted body jewelry assembly of claim 14, wherein the slot has a width to length ratio of between 1:5 and 1:1; and wherein the width of the slot is between ¼ and ½ of the width of the elongated plate.

19. The slotted body jewelry assembly of claim 14, wherein a length to width ratio for the elongated plate is between 2:1 and 3:1.

20. A slotted body jewelry assembly, comprising:

a surface anchor for body jewelry, including:

a base formed of an elongated plate having a planar top face and a planar bottom face, the elongated plate being longer than it is wide, the base having a proximate end to which a post is coupled, such that the post is coupled to and extends orthogonally from the planar top face of the base, the post having a diameter smaller than a width of the base and being positioned within an interior region of the planar top face so that the planar top face flanges outward for a distance around an entire circumference of the post, the post including a fastening structure for securing the body jewelry to the post, the base further including a distal end, the distal end including a slot interrupting a distal edge and extending from an opening at the distal edge of the base through a total thickness of the elongated base plate and inward into an internal region of the base, the slot bounded on opposite sides by a pair of elongated structures, the slot having an inner surface with two sides which extend in parallel along their entire lengths, the slot being longer than it is wide and collectively with the pair of elongated structures of the base forming a U-shape, the U-shape open at the distal edge of the base and being formed in a plane of the base that is orthogonal to the post;

wherein the base is unperforated, including no internally formed holes connecting the planar top face to the planar bottom face;

wherein the fastening structure is an internally threaded post of the surface anchor; and body jewelry removably secured to the post of the surface anchor, the body jewelry including a jeweled or ornamental surface mounted in a setting, and a threaded shaft configured to engage with the internally threaded post of the surface anchor;

wherein the inner surface of the slot is formed by the two parallel sides connected together by a curved edge on a central innermost edge of the slot;

wherein the slot has a width to length ratio of between 1:5 and 1:1;

wherein a length to width ratio for the elongated plate is between 2:1 and 3:1; and wherein the width of the slot is between ¼ and ½ of the width of the elongated plate.

* * * * *